US006274834B1

(12) United States Patent
Okada et al.

(10) Patent No.: US 6,274,834 B1
(45) Date of Patent: Aug. 14, 2001

(54) PUSH-BUTTON SWITCH WITH PART TO A WIRE ROD EXPOSED TO AN INSIDE BOTTOM OF HOUSING TO FORM A CONTACT PORTION

(75) Inventors: Mitsuhiro Okada; Hidetaka Sato, both of Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/625,327

(22) Filed: Jul. 25, 2000

(30) Foreign Application Priority Data

Jul. 27, 1999 (JP) ..... 11-212620

(51) Int. Cl.[7] ..... H01H 13/48; H01H 13/14

(52) U.S. Cl. ..... 200/520; 200/406; 200/279

(58) Field of Search ..... 200/16 R, 16 D, 200/406, 520, 275, 279, 284, 341

(56) References Cited

U.S. PATENT DOCUMENTS 3,959,611 * 5/1976 Green et al. ..... 200/5 A
3,973,091 * 8/1976 Kaminski ..... 200/5 A
4,056,700 * 11/1977 Stannek ..... 200/159 R
4,375,017 * 2/1983 Smith ..... 200/5 A
4,931,605 * 6/1990 Zoller ..... 200/408
6,049,047 * 4/2000 Miyashima et al. ..... 200/284

FOREIGN PATENT DOCUMENTS

06028947 A 4/1994 (JP) ..... H01H/13/52

* cited by examiner

*Primary Examiner*—Michael Friedhofer
(74) *Attorney, Agent, or Firm*—Brinks Hofer Gilson & Lione

(57) ABSTRACT

A structure of a push-button switch is disclosed which can prevent the occurrence of a poor conduction caused by the influence of dust which has entered the switch and ensuring a stable contact reliability despite of adopting a contact structure which uses round wire rods. The push-button switch comprises a housing having a receptacle portion, a fixed terminal formed by a wire rod, embedded in the housing, and partially projecting to the exterior of the housing, a fixed contact integral with the fixed terminal and using as a contact portion a partially exposed, raised portion of the wire rod exposed to an inside bottom of the receptacle portion of the housing, and a dome-like movable contact accommodated in the receptacle portion and capable of moving into contact with and away from the fixed contact, wherein a groove is formed in an upper surface of the raised portion of the fixed contact so as to cross the raised portion transversely and/or longitudinally, and the thus grooved-upper surface of the raised portion comes into contact with the movable contact.

13 Claims, 4 Drawing Sheets

PUSH-BUTTON SWITCH WITH PART TO A WIRE ROD EXPOSED TO AN INSIDE BOTTOM OF HOUSING TO FORM A CONTACT PORTION

BACKGROUND OF THE INVENTION

1. Field of the Invention

The present invention relates to a structure of a push-button switch for use in electronic devices such as home electric appliances, business machines, and communication devices. Particularly, the invention is concerned with a structure of a push-button switch which is required to have a dust resistance.

2. Description of the Prior Art

A conventional structure of a push-button switch is shown in FIGS. 6 to 8, of which FIG. 6 is a sectional view of the push-button switch, FIG. 7 is a sectional view of the push-button switch as seen in a direction different from FIG. 6, and FIG. 8 is a perspective view of a fixed contact formed by a wire rod.

In these figures, the push-button switch is made up of a generally cylindrical, bottomed housing 11 formed by molding a synthetic resin, a pair of fixed contacts 12 exposed to an inside bottom of the housing 11, a fixed terminal 13 integral with the fixed contacts 12 and projecting to the exterior of the housing 11, a movable contact 14 formed by a dome-like inversion spring incorporated within the housing 11 and capable of moving into contact with and away from the fixed contacts 12, a stem 15 formed of a synthetic resin, the stem 15 being mounted on the movable contact 14 and capable of moving into the housing 11, and a cover formed by a metallic plate and fixed to an upper surface of the housing 11.

The fixed contact 12 and the fixed terminal 13 are integrally formed using the same wire rod. The wire rod is a single round wire rod having been subjected to a thickness deviation working. A total of two such round wire rods are used in a partially embedded state in the housing 11.

The two round wire rods, which extend in parallel with each other, are formed with two raised portions 12*a*, respectively, which are raised upward by a thickness deviation working. By inserting these round wire rods into a cavity of a mold and molding the housing 11, the raised portions 12 exposed to the inside bottom of the housing are used as the fixed contacts 12 and the round wire rods are used as the fixed terminals.

By this insert molding, the bottoms of the raised portions 12*a* are embedded in the housing 11, so that the round wire rods are difficult to turn with respect to the housing 11 and difficult to be disengaged from the housing.

In the push-button switch described above, when an operator depresses the stem 15, the movable contact 14, which is opposed to the inside bottom of the housing 11, undergoes a depressing force and is inverted into contact with both fixed contacts 12 (raised portions 12*a*), so that the fixed contacts 12 are rendered conductive with each other through the movable contact 14, thus causing the switch to turn ON.

With the switch ON, if the depressing force for the stem 15 is released, the movable contact 14 which has been inverted reverts to the original dome shape by virtue of its own elasticity. Consequently, both fixed contacts 12 cease to conduct and the switch turns OFF. At this time, the stem 15 undergoes a biasing force of the movable contact 14 and is pushed up to its initial position.

In the above conventional push-button switch structure, however, since the raised portion 12*a* of each round wire rod is constituted as the fixed contact 12, dust which has entered the switch may adhere to the fixed contact 12 (raised portion 12*a*) and cause a poor conduction, thus giving rise to a problem in point of contact reliability.

SUMMARY OF THE INVENTION

Accordingly, it is an object of the present invention to solve the above-mentioned problems and provide a structure of a push-button switch capable of preventing the occurrence of a poor conduction caused by the influence of dust or the like which has entered the switch and ensuring a stable contact reliability despite of adopting a contact structure which uses round wire rods.

For solving the above-mentioned problems, in the first aspect of the present invention there is provided a push-button switch comprising a housing having a receptacle portion, a fixed terminal formed by a wire rod, embedded in the housing, and partially projecting to the exterior of the housing, a fixed contact integral with the fixed terminal and using as a contact portion a partially exposed, raised portion of the wire rod exposed to an inside bottom of the receptacle portion, and a dome-like movable contact accommodated in the receptacle portion and capable of moving into contact with and away from the fixed contact, wherein a groove is formed in an upper surface of the raised portion of the fixed contact so as to cross the raised portion transversely and/or longitudinally, and the thus-grooved upper surface of the raised portion comes into contact with the movable contact.

In the second aspect of the present invention, the groove is formed in V shape.

In the third aspect of the present invention, the groove is formed in a plural number.

In the fourth aspect of the present invention, the fixed contact is formed in pairs opposed to each other in the inside bottom of the receptacle portion.

DETAILED DESCRIPTION OF PREFERRED EMBODIMENTS

Figure 1:
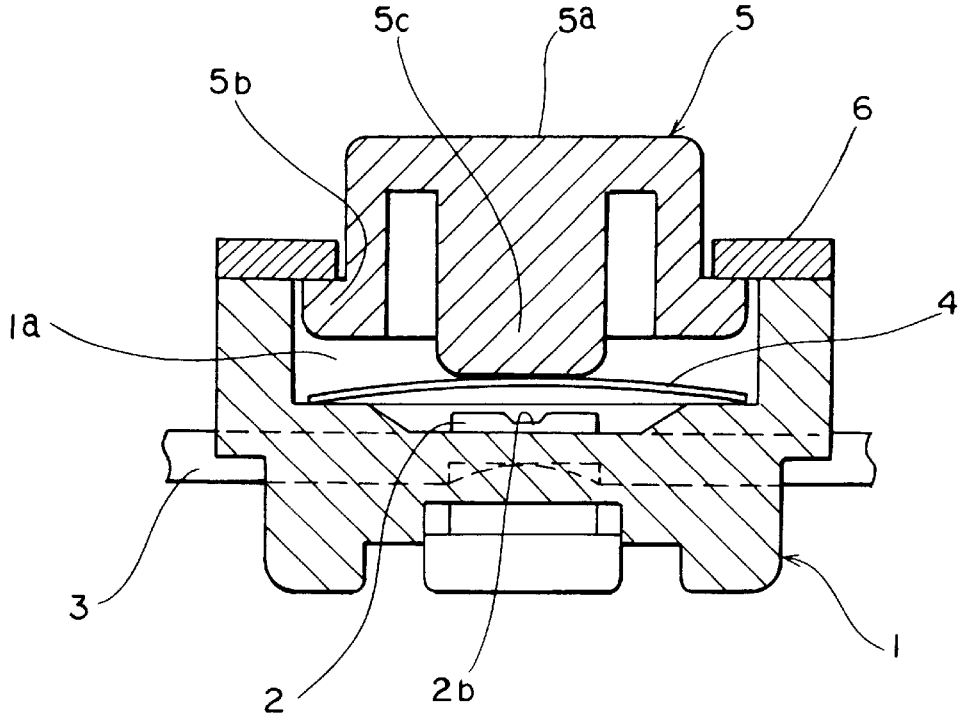
FIG. 1 is a sectional view of a push-button switch according to the first embodiment of the present invention.
Figure 2:
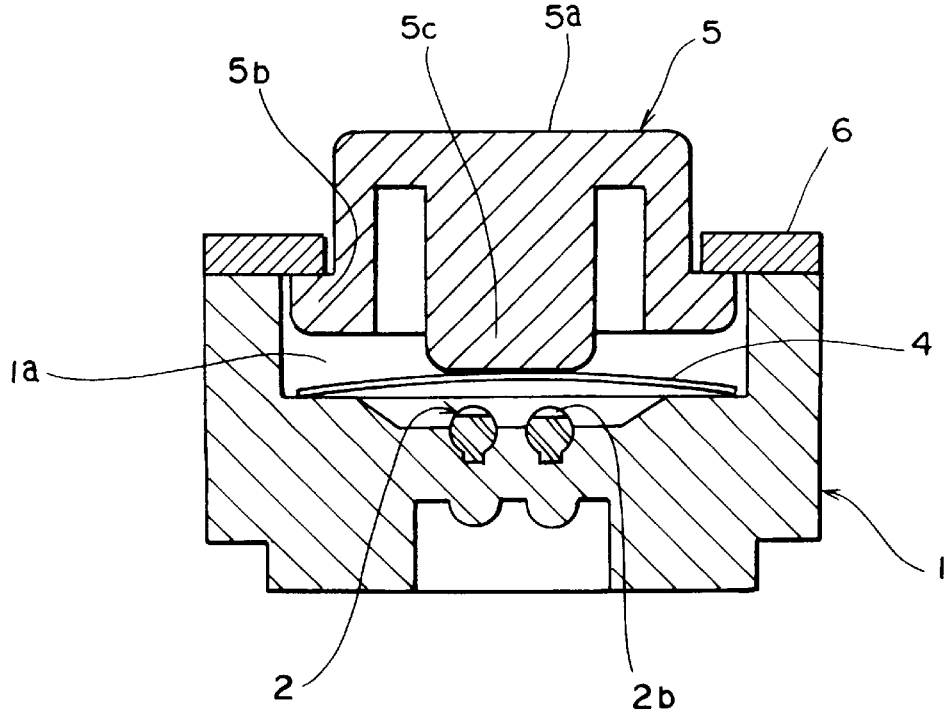
FIG. 2 is a sectional view of the push-button switch as seen in a direction different from FIG. 1.
Figure 3:
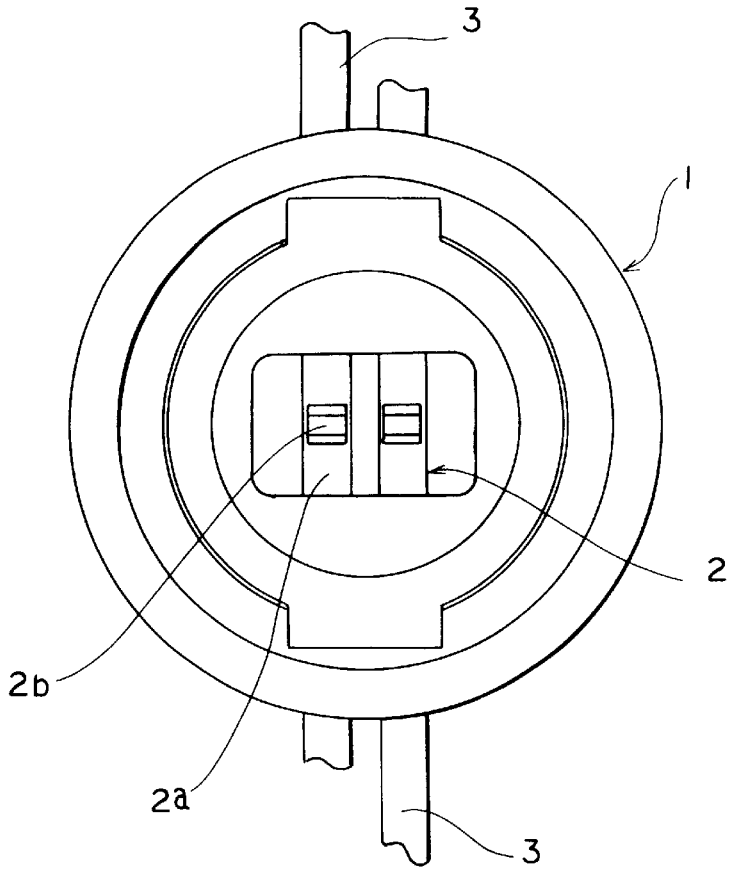
FIG. 3 is a plan view showing a housing used in the push-button switch.
Figure 4:
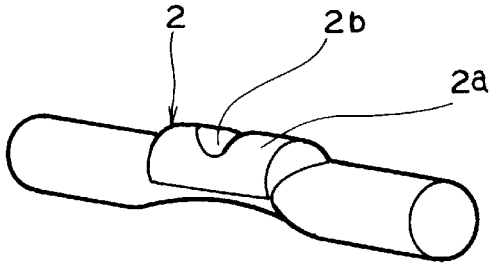
FIG. 4 is a perspective view of a fixed contact formed by a wire rod and used in the push-button switch.

A push-button switch according to the first embodiment of the present invention will be described below with reference to FIGS. 1 to 5, of which FIG. 1 is a sectional view of a push-button switch according to the first embodiment of the present invention, FIG. 2 is a sectional view of the push-button switch as seen in a direction different from FIG. 1, FIG. 3 is a plan view showing a housing of the push-button switch, and FIG. 4 is a perspective view of a fixed contact formed by a wire rod.

In these figures, a housing 1 is formed in the shape of a box having an upper opening with use of an insulating material such as a synthetic resin. The housing 1 has a receptacle portion 1*a* formed in the interior thereof. A pair of fixed contacts 2 each formed by a round wire rod are embedded opposedly to each other in the housing 1 by insert molding for example. More specifically, part of a round wire rod is raised to form a raised portion 2*a*, which raised portion is exposed to an inside bottom of the housing 1 to constitute a contact portion of each fixed contact 2. The fixed contacts 2 are positioned side by side at a predetermined certain interval nearly centrally of the inside bottom of the housing 1. A dome-like movable contact to be described later comes into abutment against the fixed contacts 2, making both fixed contacts conductive with each other and thereby causing the switch to turn ON.

In an upper surface of the raised portion 2*a* of each fixed contact 2 is formed a groove 2*b* which crosses the raised portion in a direction orthogonal to the longitudinal direction of the wire rod which constitutes the raised portion. The groove 2*b* has a bottom and is formed in a generally V shape expanded on the upper surface side. Since the groove 2*b* is formed so as to cross the wire rod transversely, both side faces of the groove 2*b* are open.

In the housing 1 there are provided fixed terminals 3 formed by the same round wire rods as the fixed contacts 2 and projecting to the exterior of the housing. The fixed terminals 3 are embedded in the housing 1 while being kept in conduction with the fixed contacts 2.

The movable contact 4 is formed in the shape of a dome by an electrically conductive, resilient, metallic plate such as a plate of phosphor bronze for spring or stainless steel. Since the movable contact 4 is formed in a dome shape, there is obtained a biasing force for restoring a stem to be described later, in addition to the inverting force of the movable contact.

A stem 5 is formed in a generally cylindrical shape by an insulating material such as a synthetic resin. The stem 5 comprises an operating portion 5*a* projecting from the opening of the housing 1, a flange portion 5*b* which is abutted against a cover to be described later and is thereby prevented from being disengaged from the housing, and a pressing portion 5*c* which presses the movable contact 4 toward the fixed contacts 2.

A cover 6 is formed by a metallic plate such as a stainless steel plate and is attached to the upper opening of the housing 1. The cover 6 not only functions as a lid of the housing 1 but also prevents the stem 5 from being disengaged from the housing.

The operation of the above push-button switch will now be described. First, when the operating portion 5*a* of the stem 5 is depressed from the exterior with a human finger for example, the pressing portion 5*c* formed at a lower end of the stem 5 depresses the dome-like movable contact 4. As a result, the movable contact 4 is inverted into abutment against the fixed contacts 2 by virtue of its own resilience, so that the fixed contacts are rendered conductive with each other through the movable contact 4, causing the switch to turn ON.

In this case, the upper surfaces of the raised portions 2*a* as contact portions of the fixed contacts are respectively formed with the grooves 2*b* whose both side faces are open, so even if dust such as substrate dust or stain is adhered to the raised portions 2*a* (contact portions), it is possible to let the dust fall into the grooves 2*b* and hence possible to prevent the occurrence of a poor conduction or poor contact.

In addition, since the grooves 2*b* are formed in the raised portions 2*a* respectively, it is possible to double the number of contact portions for contact with the movable contact 4 from the initial two to four, where by electrical conduction and contact can be stabilized.

It is optional whether the groove 2*b* is to be formed so as to cross the round wire rod in a direction orthogonal to the longitudinal direction of the wire rod or cross the wire rod longitudinally. In the former case, the width of the groove is not limited by the wire rod diameter and therefore the spacing between contact portions defined by the groove can be made so much larger than in the latter case.

Where the groove 2*b* is formed in a generally V shape so as to cross the raised portion 2*a* of each fixed contact transversely of the round wire rod which constitutes the raised portion 2*a*, it is possible to use a mold of a simpler structure, and even in case of using a wire rod of a smaller diameter, the wire rod can be machined easily.

Further, since both side faces of each groove 2*b* are open, dust does not stay within the groove but is discharged to the exterior of the raised portion 2*a* (contact portion), thus ensuring stable conduction and contact.

Upon release of the depressing force on the stem 5, the stem is pushed up to its initial position with the resilient inverting force of the movable contact 4 itself. At this time, the movable contact 4 reverts to the original dome shape by virtue of its own resilience, with the result that the fixed contacts 2 cease to conduct and the switch turns OFF.

Figure 5:
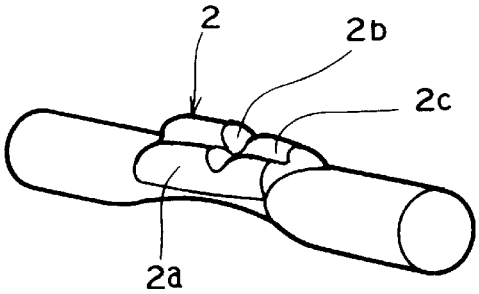
FIG. 5 is a perspective view of a fixed contact used in a push-button switch according to the second embodiment of the present invention.
Figure 6:
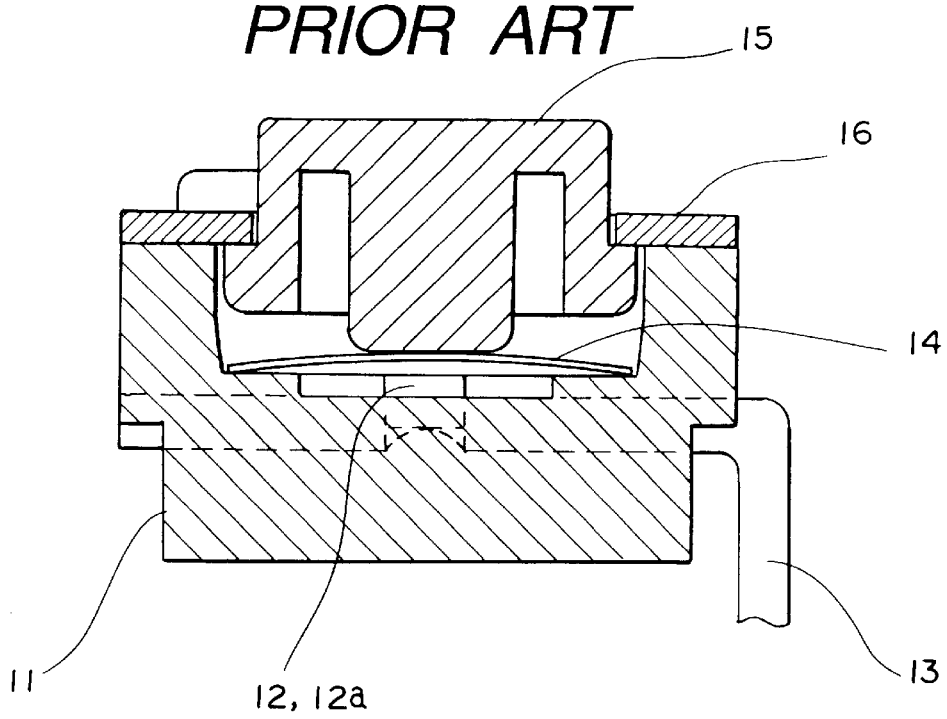
FIG. 6 PRIOR ART
FIG. 6 is a sectional view showing a conventional push-button switch.
Figure 7:
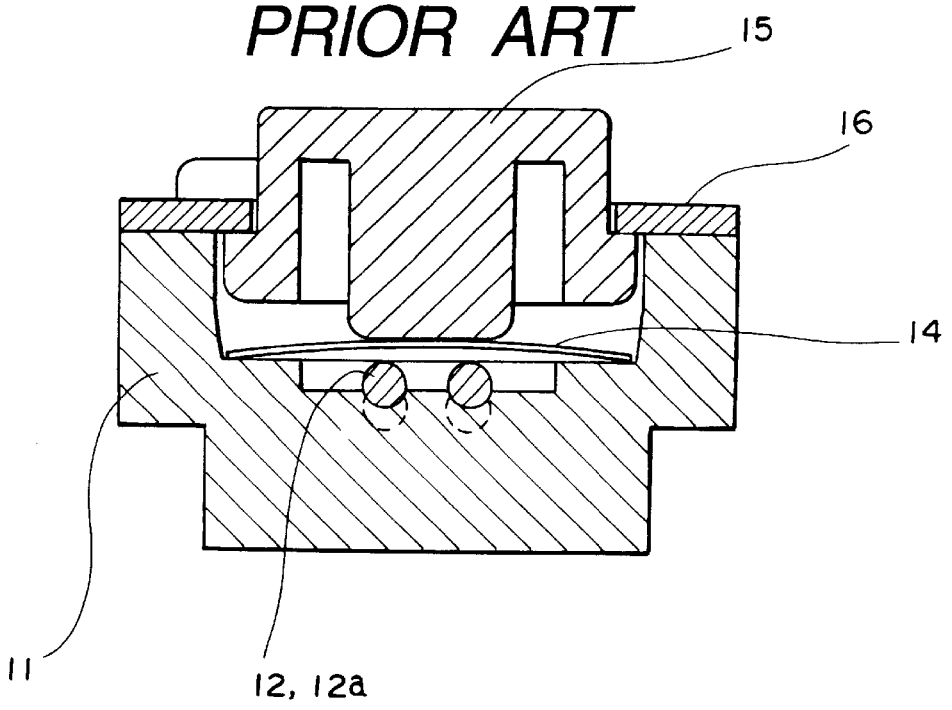
FIG. 7 PRIOR ART
FIG. 7 is a sectional view of the conventional push-button switch as seen in a direction different from FIG. 6.
Figure 8:
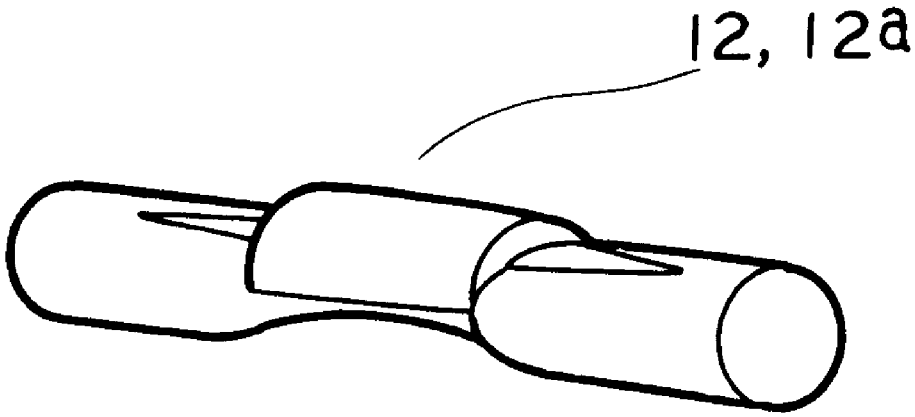
FIG. 8 PRIOR ART
FIG. 8 is a perspective view of a fixed contact formed by a wire rod and used in the conventional push-button switch.

Reference is now made to FIG. 5, which is a perspective view of a fixed contact used in a push-button switch according to the second embodiment of the present invention.

A difference from the first embodiment resides in a different shape of a groove 2*b* formed in each fixed contact 2. In this second embodiment, a groove 2*c* is formed so as to cross the raised portion 2*a* of each fixed contact 2 longitudinally of a round wire rod which constitutes the raised portion, in addition to the groove 2*b* which crosses the wire rod transversely.

Forming such plural grooves 2*b* and 2*c* in the raised portion 2*a* as in the above second embodiment is advantageous in that the number of dust particles adhered to the upper surface of each raised portion 2*a* can be decreased and it is possible to increase the number of contact portions which come into contact with the movable contact 4, thus ensuring stabler conduction and contact.

Although in the above second embodiment of the present invention the grooves 2*b* and 2*c* are formed so as to cross the raised portion 2*a* of each fixed contact 2 transversely and longitudinally, respectively, of the wire rod which constitutes the raised portion, the number of each of the grooves 2*b* and 2*c* is not limited to one, but each may be formed in a plural number, or one of the two grooves may be formed plurally. It goes without saying that also in such modifications there can be obtained the same effect as above.

Although in the above embodiments the grooves 2*b* and 2*c* are formed in a generally V shape, the groove shape is not limited to such a V shape insofar as the grooves formed are each bottomed and expanded on the upper surface side. It is preferable for the grooves to have a shape which permits the use of a mold of a simple structure and which can be formed easily even in case of using a wire rod of a small diameter.

As set forth above, the push-button switch according to the present invention is provided with fixed contacts integral with fixed terminals and having, as contact portions, raised portions of wire rods partially exposed to an inside bottom of a housing, and is also provided with a dome-like movable contact capable of moving into contact with and away from the fixed contacts. Further, a groove (or grooves) is formed in an upper surface of each of the raised portions of the fixed contacts so as to cross the raised portion transversely and/or longitudinally, and the upper surface of the raised portion having the groove is contacted with the movable contact. Therefore, even if dust such as substrate dust or stain adheres to the each raised portion (contact portion), it is possible to let the dust fall into the groove and hence possible to prevent the occurrence of poor conduction and poor contact.

In addition, since the groove is formed in V shape, a mold of a simpler structure is employable, and even in case of using a wire rod of a small diameter, the groove can be formed easily.

Moreover, since both side faces of the groove are open, dust does not stay in the groove, but is discharged from both side faces of the groove to the exterior of the raised portion (contact portion), there can be attained stabler conduction and contact.

Further, if the groove is formed in a plural number for the raised portion of each fixed contact, it is possible to decrease the number of dust particles adhered to the upper surface of the raised portion and increase the number of contact portions for contact with the movable contact, thus making it possible to stabilize electrical conduction and contact.

Additionally, since the fixed contacts are disposed in pairs in the inside bottom of the receptacle portion, it is not necessary to bend the fixed contacts or arrange them on different levels, thus affording a simple and less expensive contact structure.

What is claimed is:

1. A push-button switch comprising:

a housing enclosing a receptacle portion;

a fixed terminal formed by a wire rod embedded in the housing and partially projecting to an exterior of the housing;

a fixed contact arranged within the receptacle portion and having a raised contact portion electrically connected to the fixed terminal, said raised contact portion protruding from an inner bottom surface of the housing toward an interior area of the receptacle portion, said raised contact portion having a rounded upper surface comprising an electrical contact point; and a dome-like movable contact disposed within the receptacle portion and capable of moving into surface-contact with the electrical contact point of the fixed contact, wherein a groove is formed in the upper surface of the raised contact portion of the fixed contact, said groove being formed adjacent to the electrical contact point so as to provide an area for the accumulation of dust away from the electrical contact point, thereby preventing the dust from interfering with the surface-contact of the movable contact with the electrical contact point of the fixed contact.

2. A push-button switch according to claim 1, wherein the groove is formed in a V-shape.

3. A push-button switch according to claim 2, wherein the V-shaped groove has a bottom portion connected between two upper surface sides so as to form a trapezoidal shape, said upper surface sides having a length that is longer than a length of the bottom portion.

4. A push-button switch according to claim 1, wherein the fixed contact is formed in pairs disposed sided-by-side on the inner bottom surface of the housing.

5. A push-button switch according to claim 1, wherein the groove is formed in a direction that is transverse to a direction of the raised contact portion of the fixed contact.

6. A push-button switch according to claim 5, wherein the groove is formed in a V-shape.

7. A push-button switch according to claim 6, wherein the V-shaped groove has a bottom portion connected between two upper surface sides so as to form a trapezoidal shape, said upper surface sides having a length that is longer than a length of the bottom portion.

8. A push-button switch according to claim 1, wherein the groove is formed in a direction that is parallel to a direction of the raised contact portion of the fixed contact.

9. A push-button switch according to claim 8, wherein the groove is formed in a V-shape.

10. A push-button switch according to claim 9, wherein the V-shaped groove has a bottom portion connected between two upper surface sides so as to form a trapezoidal shape, said upper surface sides having a length that is longer than a length of the bottom portion.

11. A push-button switch according to claim 1, wherein the groove comprises a pair of grooves, one of said grooves being formed in a direction that is transverse to a direction of the raised contact portion of the fixed contact, and the other said groove being formed in a direction that is parallel to the direction of the raised contact portion of the fixed contact.

12. A push-button switch according to claim 11, wherein the grooves are each formed in a V-shape.

13. A push-button switch according to claim 12, wherein the V-shaped grooves each have a bottom portion connected between two upper surface sides so as to form a trapezoidal shape, said upper surface sides having a length that is longer than a length of the bottom portion.

* * * * *